US009851055B2

(12) United States Patent
Gielen et al.

(10) Patent No.: US 9,851,055 B2
(45) Date of Patent: Dec. 26, 2017

(54) LIGHTING DEVICE WITH MECHANICAL FASTENING PART

(71) Applicant: PHILIPS LIGHTING HOLDING B.V., Eindhoven (NL)

(72) Inventors: Vincent Stefan David Gielen, Eindhoven (NL); Miroslaw Zynda, Eindhoven (NL); Winand Hendrik Anna Maria Friederichs, Eindhoven (NL); Georges Marie Calon, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/322,105

(22) PCT Filed: Jun. 26, 2015

(86) PCT No.: PCT/EP2015/064475
§ 371 (c)(1),
(2) Date: Dec. 24, 2016

(87) PCT Pub. No.: WO2015/197805
PCT Pub. Date: Dec. 30, 2015

(65) Prior Publication Data

US 2017/0138542 A1 May 18, 2017

(30) Foreign Application Priority Data

Jun. 27, 2014 (EP) ..... 14174837
Dec. 8, 2014 (EP) ..... 14196703

(51) Int. Cl.
*F21V 17/00* (2006.01)
*F21K 9/232* (2016.01)
(Continued)

(52) U.S. Cl.
CPC ..... *F21K 9/232* (2016.08); *F21K 9/235* (2016.08); *F21V 17/04* (2013.01); *F21V 17/10* (2013.01);
(Continued)

(58) Field of Classification Search
CPC ..... F21K 9/232; F21K 9/235; F21V 17/04; F21V 17/10; F21V 17/104; F21Y 2115/10
See application file for complete search history.

(56) References Cited

U.S. PATENT DOCUMENTS 7,079,041 B2 * 7/2006 Fredericks et al. .... B64D 47/06 340/321
7,810,968 B1 10/2010 Walker et al.
(Continued)

FOREIGN PATENT DOCUMENTS

CN 203115641 U 8/2013
CN 203223799 U 10/2013

*Primary Examiner* — Stephen F Husar

(57) ABSTRACT

A lighting device (1) and a method of manufacturing a lighting device is provided. The lighting device comprises an envelope (100), a light generating unit (120), a stem (130) arranged to support the light generating unit inside the envelope, and a mechanical fastening part (110) arranged to fasten the light generating unit at the stem. The mechanical fastening part comprises at least one protrusion (115) and the light generating unit comprises at least one hole (126) adapted to mate with the at least one protrusion so as to fasten the light generating unit to the mechanical fastening part.

14 Claims, 13 Drawing Sheets

(51) Int. Cl.

| | |
|---|---|
| ***F21V 17/04*** | (2006.01) |
| ***F21K 9/235*** | (2016.01) |
| ***F21V 17/10*** | (2006.01) |
| *F21Y 115/10* | (2016.01) |

(52) U.S. Cl.
CPC ..... *F21V 17/104* (2013.01); *F21Y 2115/10* (2016.08)

(56) References Cited

U.S. PATENT DOCUMENTS

| | | | |
|---|---|---|---|
| 8,591,062 | B2 | 11/2013 | Hussell et al. |
| 2011/0228529 | A1 | 9/2011 | Patel et al. |
| 2014/0340913 | A1 | 11/2014 | Cui |

* cited by examiner

LIGHTING DEVICE WITH MECHANICAL FASTENING PART

CROSS-REFERENCE TO PRIOR APPLICATIONS

This application is the U.S. National Phase application under 35 U.S.C. §371 of International Application No. PCT/EP2015/064475, filed on Jun. 26, 2015, which claims the benefit of European Patents Applications Nos. 14196703.4, filed on Dec. 8, 2014, and 14174837.6, filed on Jun. 27, 2014. These applications are hereby incorporated by reference herein.

FIELD OF THE INVENTION

The present invention generally relates to the field of lighting devices. In particular, the present invention relates to lighting devices comprising a light generating unit and a stem for supporting the light generating unit in an envelope of the lighting device.

BACKGROUND OF THE INVENTION

Traditional incandescent lighting devices are currently being replaced by more energy efficient alternatives, such as halogen lighting devices and LED lighting devices. When designing new lighting devices, it is desirable to resemble the traditional design of incandescent lighting devices in order to enable use of existing manufacturing equipment.

In traditional incandescent light bulbs, a tungsten filament is normally supported in a glass envelope by means of a glass stem. An LED based lighting device comprising a light generating unit supported by a core column in an envelope is shown in CN 203115641 U. The light generating unit is connected to the core column by means of a steel needle and a chuck. A drawback with such a lighting device is that the structure for fastening the light generating unit to the core column is rather complex, thereby rendering manufacturing of the lighting device cumbersome.

SUMMARY OF THE INVENTION

It would be advantageous to achieve a lighting device and a method of manufacturing a lighting device overcoming, or at least alleviating, the above mentioned drawback. In particular, it would be desirable to enable facilitated manufacturing of a lighting device.

To better address one or more of these concerns, a lighting device and a method of manufacturing a lighting device having the features defined in the independent claims are provided. Preferable embodiments are defined in the dependent claims.

Hence, according to a first aspect, a lighting device is provided. The lighting device comprises an envelope, a light generating unit, a stem arranged to support the light generating unit inside the envelope, and a mechanical fastening part arranged to fasten the light generating unit at the stem. The mechanical fastening part comprises at least one protrusion and the light generating unit comprises at least one hole adapted to mate with the at least one protrusion so as to fasten the light generating unit to the mechanical fastening part.

According to a second aspect, a method of manufacturing a lighting device is provided. The method comprises arranging a mechanical fastening part on a stem, the mechanical fastening part comprising at least one protrusion, and arranging a light generating unit comprising at least one hole on the mechanical fastening part such that the at least one hole mates with the at least one protrusion, thereby fastening the light generating unit to the mechanical fastening part. The method further comprises arranging the stem at least partially inside an envelope such that the light generating unit is supported by the stem in the envelope.

The present invention is based on an idea of using a stem for supporting the light generating unit in the envelope, which enables making use of existing manufacturing equipment previously used for incandescent lighting devices having a similar stem. By using a mechanical fastening part in order to connect the light generating unit to the stem, it is possible to make use of a stem designed similar to a traditional glass stem of an incandescent lighting device. As the light generating unit is coupled to the stem by mating the protrusion of the mechanical fastening part with the hole in the light generating unit, the structure of the mechanical fastening part can be less complex and manufacturing of the lighting device is facilitated. For example, the present aspect allows making the mechanical fastening part in a single piece of material. Further, the mechanical fastening part may provide a more rigid connection between the light generating unit and the stem, which may better cope with high g-forces that may occur during handling in the factory or by the end user. Moreover, the at least one hole of the light generating unit may be used to position and hold the light generating unit in an assembly tool, which further facilitates manufacturing.

The mechanical fastening part may alternatively be referred to as mechanical fixation means.

The stem may be an elongated part, preferably extending in a direction along an optical axis of the lighting device.

Further, the at least one protrusion mating with the at least one hole may include that the at least one protrusion extends into (optionally through) the hole such that the at least one protrusion may engage with a portion of the light generating unit at the hole. The light generating unit being fastened to the stem may not necessarily mean that it is completely fixed to the stem, (at least some) movement of the light generating unit relative to the stem may be allowed in one or more degrees of freedom as long as the light generating unit is supported by the mechanical fastening part on the stem in the envelope.

According to an embodiment, the at least one hole may comprise a through hole. Hence, the at least one protrusion may be mated with the at least one through hole by being inserted in the through hole, which facilitates fastening the light generating unit to the mechanical fastening part. A through hole allows inserting the protrusion in the hole such that the protrusion projects out of the hole, whereby the tip of the projecting portion of the protrusion may be deformed so as to hinder the light generating unit to come off from the protrusion. Alternatively (or additionally), the at least one hole may comprise a blind hole (such as a recess or indent). It will be appreciated that the at least one hole may have any suitable shape, such as elongated, circular or polygonal.

According to an embodiment, the mechanical fastening part may comprise a plurality of protrusions arranged (circumferentially) around a longitudinal axis of the stem. Preferably, the light generating unit may comprise a plurality of holes adapted to mate with the plurality of protrusions. Thus, the plurality of holes of the light generating unit may also be arranged (circumferentially) around the stem. According to an embodiment, the light generating unit may be arranged to at least partially surround the mechanical fastening part. Further, the light generating unit may be arranged to at least partially surround the stem. Each one of the present embodiments allow using a chimney-like light generating unit adapted to emit light in radial directions from the lighting device while providing a more rigid fastening of the light generating unit to the stem. Further, such chimney-like shape of the light generating unit may be advantageous in that it facilitates heat dissipation the light generating unit, as it enables heat convention through the chimney-like light generating unit. Manufacturing of the lighting device is facilitated since the light generating unit may be wound onto (or rolled upon) the mechanical fastening part around the longitudinal axis of the stem.

According to an embodiment, the light generating unit may comprise one or more carriers and one or more solid state light sources arranged at the one or more carriers. The one or more carriers may e.g. comprise one or more rigid or flexible circuit boards (such as printed circuit boards, PCBs). The one or more solid state light sources may e.g. comprise one or more light emitting elements, LEDs. In an embodiment, a plurality of carriers may be interlinked so as to form a partially flexible structure able to be wound around the mechanical fastening part and the stem, which facilitates manufacturing of the lighting device. According to an embodiment, the at least one hole may be arranged in the carrier, thereby allowing fastening the carrier to the mechanical fastening part.

According to an embodiment, the mechanical fastening part may comprise a metal sheet. Since the structure for fastening the light generating unit to the stem is simplified by using the mechanical fastening part with one or more protrusions, a metal sheet (optionally a single metal sheet) can be used for forming the mechanical fastening part. A metal sheet is relatively easy to form into a desired shape, which facilitates manufacturing of the lighting device. In an embodiment, the metal sheet may be folded and/or deep drawn so as to define at least one geometrical feature adapted to fasten the mechanical fastening part to the stem. Thus, no additional part further to the metal sheet is necessary for fastening the mechanical fastening part to the stem, whereby the structure of the lighting device is less complex and manufacturing is facilitated. It will be appreciated that in embodiments wherein the mechanical fastening part is made of a material other than a metal sheet, the mechanical fastening part may comprise a geometrical feature adapted to fasten the mechanical fastening part to the stem. The geometrical feature may then be formed in a way suitable for processing the material, such as folding or casting.

According to an embodiment, an edge (such as a rim) of the metal sheet may be shaped so as to define the at least one protrusion. For example, the metal sheet may be cut so as to form the edge with one or more protrusions, whereby manufacturing of the lighting device is further facilitated.

For example, the geometrical feature of the mechanical fastening part may be arranged at a center portion of the mechanical fastening part, and the one or more protrusions may be arranged circumferentially around the center part, whereby the light generating unit may be wound onto the mechanical fastening part.

According to an embodiment, the stem may comprise a geometrical feature arranged to mate with a geometrical feature of the mechanical fastening part so as to fasten the mechanical fastening part to the stem. For example, the mechanical fastening part may be snapped onto the stem and/or the geometrical feature of the mechanical fastening part may be deformed after having been applied to the stem so as to mate with the geometrical feature of the stem for locking the mechanical fastening part to the stem. The present embodiment facilitates manufacturing of the lighting device.

In general, in the present specification, the term "geometrical feature" means a formation going inwards or outwards in a structure, such as a protrusion, an indent, a recess, a blind-hole a through-hole, a corner or edge. Further, a geometrical feature of a part may be adapted to mate with a geometrical feature of another part so as to hinder movement between the two parts in at least one degree of freedom.

According to an embodiment, the stem may be light transmissive, whereby the affection of the stem on the light distribution of the lighting device is reduced. For example, the stem may comprise glass, whereby the stem may resemble a standard stem used in traditional incandescent light bulbs for supporting the filament, which in turn facilitates use of manufacturing equipment previously used for such traditional incandescent light bulbs.

According to an embodiment, the lighting device may further comprise a cap connected to the envelope and supporting the stem in the envelope. The cap may be arranged so as to electrically, and preferably also mechanically, couple the lighting device to an outside power supply. The cap may be arranged at the lower side of the stem. The lighting device may further comprise a driver for driving the light generating unit and being electrically coupled to the outside power supply via the cap.

According to an embodiment, the at least one protrusion may be shaped so as to lock the light generating unit to the mechanical fastening part. For example, the at least one protrusion may be deformed, such as folded or twisted, so as to prevent itself from slipping out of the hole. With the present embodiment, manufacturing of the lighting device is facilitated and a rigid fastening of the light generating unit to the mechanical fastening part is provided since the at least one hole of light generating unit may first be threaded on to the at least one protrusion of the mechanical fastening part and then the at least one protrusion (such as the end portion of the protrusion) may be deformed so as to lock the light generating unit to the mechanical fastening part.

It is noted that embodiments of the invention relates to all possible combinations of features recited in the claims. Further, it will be appreciated that the various embodiments described for the lighting device are all combinable with embodiments of the method as defined in accordance with the second aspect.

BRIEF DESCRIPTION OF THE DRAWINGS

These and other aspects will now be described in more detail with reference to the appended drawings showing embodiments.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION

The present aspects will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspects to the skilled person.

Figure 1:
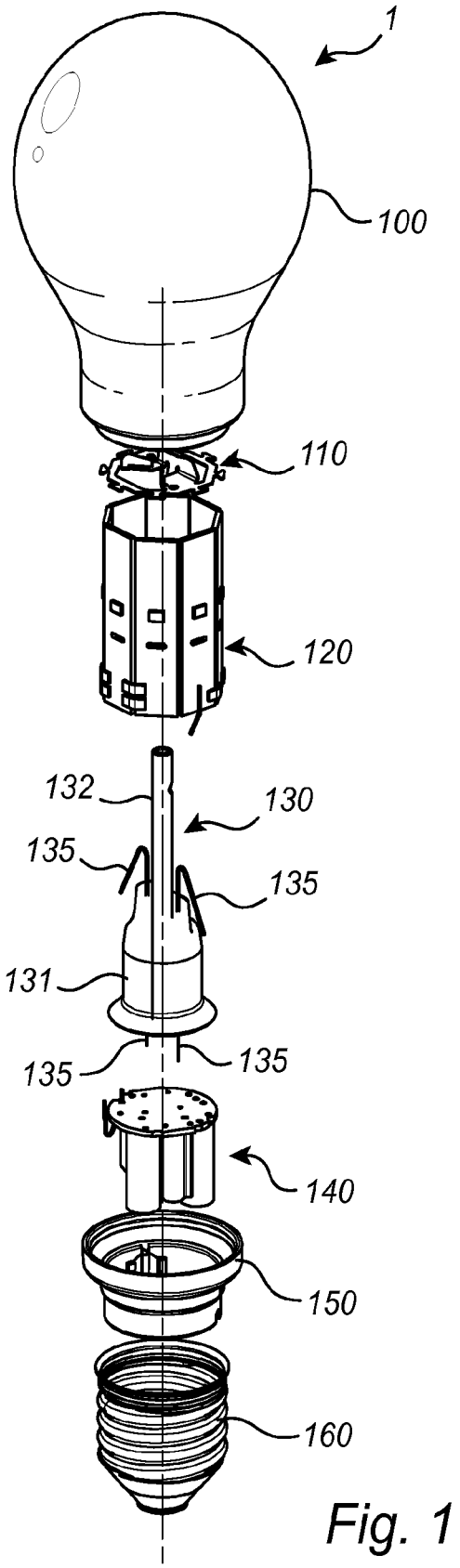
FIG. 1 is an exploded view of a lighting device according to an embodiment.

A lighting device according to an embodiment will be described with reference to FIG. 1 showing an exploded view of the lighting device. It will be appreciated that the examples of various features of the lighting device described with reference to FIG. 1 are combinable with other embodiments.

The lighting device 1 may comprise an envelope 100, e.g. shaped as a bulb, a light generating unit 120, a stem 130 arranged to support the light generating unit in the envelope 100 and a mechanical fastening part 110 arranged to fasten the light generating unit 120 to the stem 130. The stem 130 may extend along the optical axis of the lighting device 1. The stem 130 may be light transmissive. For example, the stem 130 may be made of glass or any other transparent or translucent material. Optionally, the stem 130 may comprise a base portion 131 and a pump tube portion 132 having a smaller diameter than the base portion 131. Wires 135 may be arranged at the stem 130 for electrically connecting the light generating unit 120 to a driver 140 of the lighting device 1. The lighting device 1 may further comprise a cap 160 for electrically connecting the driver 140 to a power supply. For example, the cap 160 may be a screw base. The cap 160 may be arranged at the lower end of the stem 160. The lighting device 1 may further comprise an isolation part 150 arranged to electrically isolate the driver 140 from the cap 160.

According to an embodiment, the envelope 100 may be filled with a Helium-Oxygen mixture. In lighting devices with such a gas mixture, the internal thermal resistance may be relatively high. Therefore, the light generating unit 120 may preferably have a chimney-like shape, as illustrated in more detail in FIG. 2, so as to function as a thermal chimney, which enhances heat dissipation from the light generating unit 120. For example, the light generating unit 120 may comprise one or more carriers 121 arranged around the stem 130 so as to form a chimney-like structure. The one or more carriers 121 may e.g. be one or more circuit boards, such as one or more printed circuit boards, PCBs. The carriers 121 may be interconnected by means of connecting elements 122. One or more light sources 123 may be arranged on the one or more carriers 121.

Figure 2:
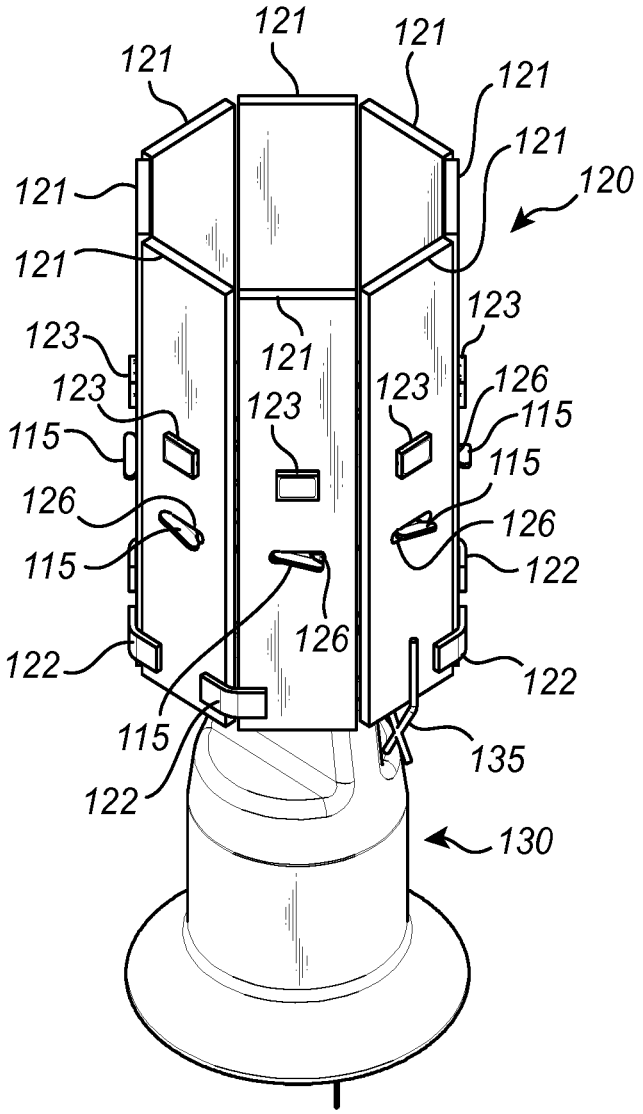
FIG. 2 shows a light generating unit mounted to a stem of the lighting device shown in FIG. 1.

The mechanical fastening part 110 may comprise one or more protrusions 115 and the light generating unit 120 may comprise one or more holes 126 adapted to mate with the protrusions 115 so as to fasten the light generating unit 120 to the mechanical fastening part 110. For example, the holes 126 may be located in the one or more carriers 121, as illustrated in FIG. 2. The protrusions 115 may e.g. extend through the holes 126 of the light generating unit 120, such that the light generating unit 120 is supported by the protrusions 115. Further, the protrusions 115 may be slightly deformed, such as bent or twisted, so as to reduce the risk of the light generating unit 120 coming off the protrusions 115 and to reduce possible movement between the light generating unit 120 and the stem 130. The mechanical fastening part 110 may be formed by a single piece of material, such as metal. Preferably, the mechanical fastening part 110 may be formed by a piece of sheet metal. The desired shape of the mechanical fastening part 110 may e.g. be achieved by cutting, folding and/or deep drawing. For example, the metal sheet may be cut such that the rim of the metal sheet forms the protrusions 115.

In the following, mechanical fastening parts and stems according to different embodiments will be described in more detail. The mechanical fastening parts and stems according to the embodiments described in the following may in general be similarly configured as the mechanical fastening part 110 and the stem 130 as described with reference to FIGS. 1 and 2.

Figure 3A:
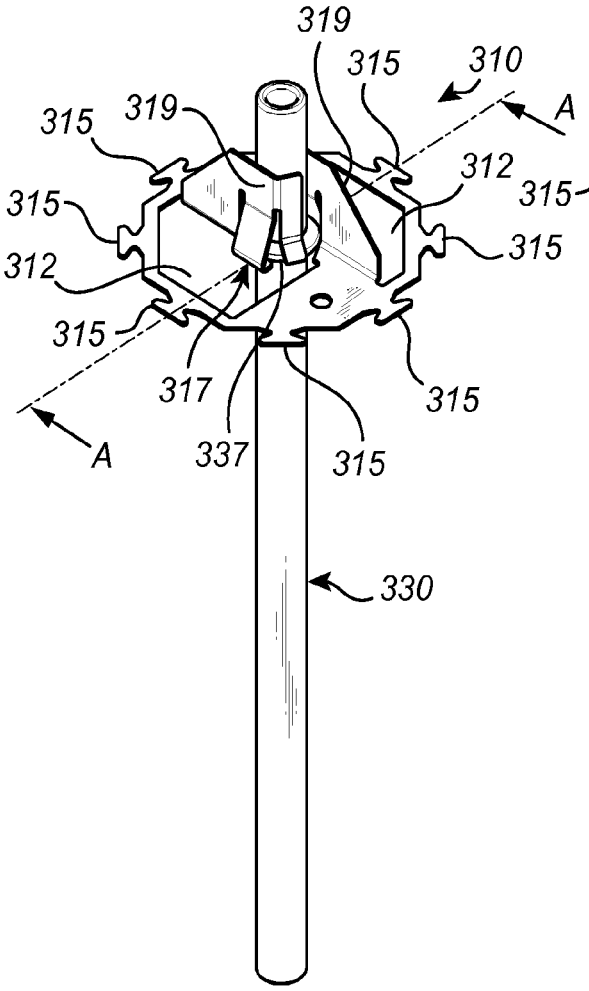
FIGS. 3*a*-3*c* show a mechanical fastening part connected to a stem according to an embodiment.
Figure 3B:
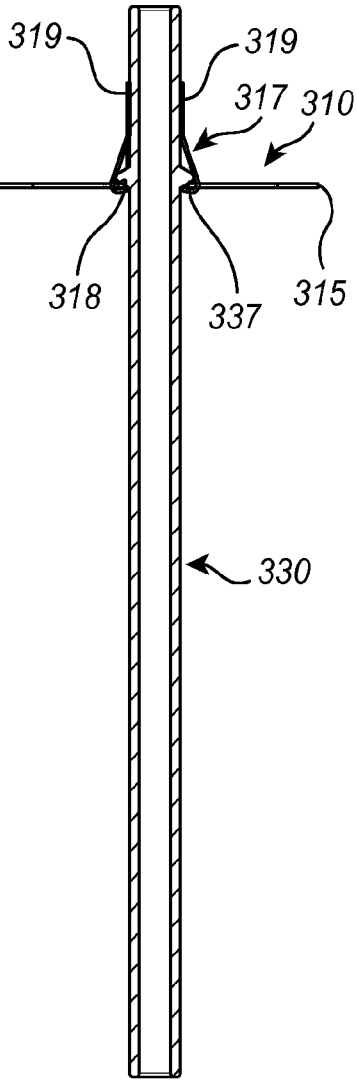
Figure 3C:
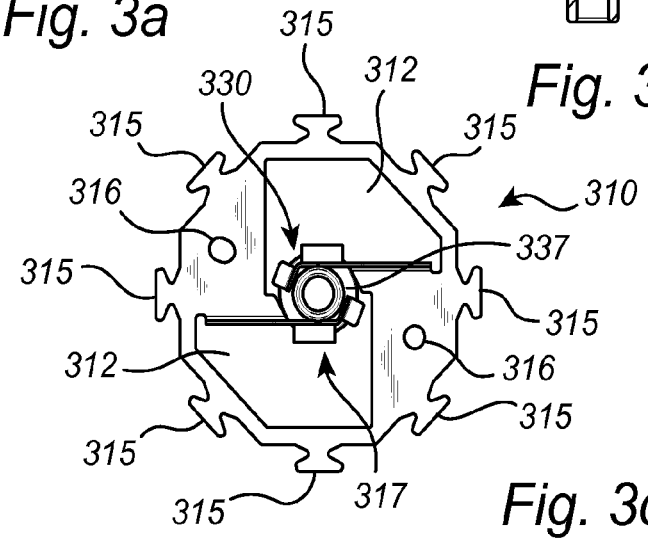

FIGS. 3*a* to 3*c* show a mechanical fastening part 310 connected to a stem 330 according to an embodiment. FIG. 3*a* is a perspective view, FIG. 3*b* is a cross-section taken along line A-A in FIG. 3*a*, and FIG. 3*c* is a top view.

The mechanical fastening part 310 may be arranged around a longitudinal axis of the stem 330, such that the protrusions 315 extend radially away from the stem 330 to be able to mate with the holes of the light generating unit arranged around a longitudinal axis of the stem 330 (e.g. as illustrated in FIG. 2). Further, a void (such as blind hole or a through hole) may be located at a center portion of the mechanical fastening part 310 for enabling threading the mechanical fastening part 310 onto the stem 330.

The mechanical fastening part 310 may further comprise a geometrical feature 317 adapted to mate with the stem 330, such as with a geometrical feature 337 of the stem 330. In the present example, the geometrical feature 337 of the stem 330 comprises a protrusion in the shape of a rim extending around the stem 330 and the geometrical feature 317 of the mechanical fastening part 310 comprises an indent 318 adapted to mate with the rim. The geometrical feature 317 of the mechanical fastening part 310 may further comprise one or more flanges 319 or the like arranged around the void so as to support the mechanical fastening part 310 around the stem 330, whereby motion of the mechanical fastening part 310 relative to the stem 330 in the radial direction of the stem 330 is limited. Preferably, the geometrical features 317 and 337 of the mechanical fastening part 310 and the stem 330 may be arranged so as to limit motion of the mechanical fastening part 310 relative to the stem 330 in the longitudinal direction of the stem 330 and preferably also any tilt motion of the mechanical fastening part 310 relative to the stem 330.

The mechanical fastening part 330 may comprise one or more voids 312 arranged somewhere between the protrusions 315 and the geometrical feature 317 of the mechanical fastening part 330. The voids 312 enhance heat convention through the light generating unit, as they allow heat to flow along the stem 330. In the present example, the metal sheet of the mechanical fastening part 330 may be folded so as to form the geometrical feature 317. Thus, the metal sheet may be cut and folded so as to form the flanges 319 and the indent 318. As the flanges 319 are folded towards the stem 330, the voids 312 are provided between the geometrical feature 317 and the protrusions 315.

Optionally, the mechanical fastening part 310 may further comprise one or more holes 316 arranged for facilitating fixing the mechanical fastening part 310 in an assembly tool. Further, in the present example, the general extension of the metal sheet forming the mechanical fastening part 310 may be transverse (such as substantially perpendicular) to the longitudinal direction of the stem 330.

Figure 4A:
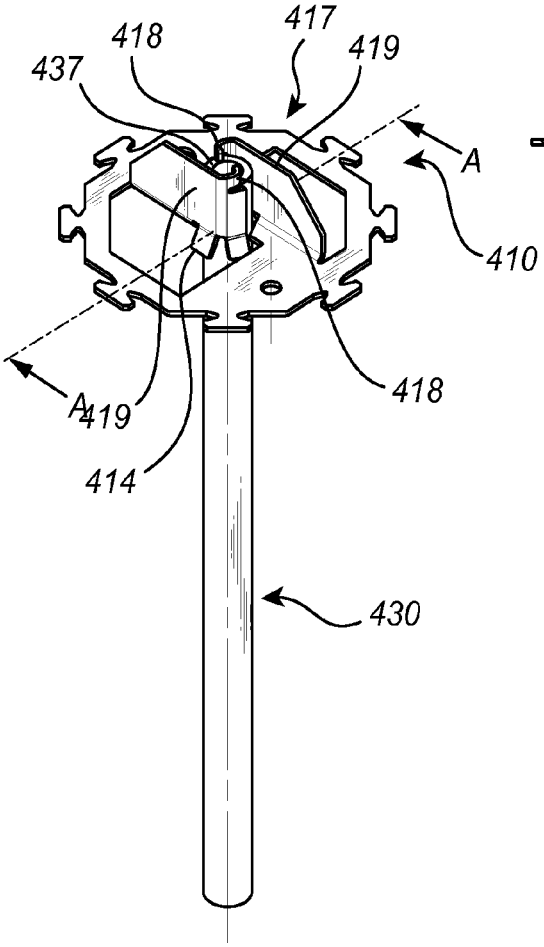
FIGS. 4*a* to 4*c* show a mechanical fastening part connected to a stem according to another embodiment.
Figure 4B:
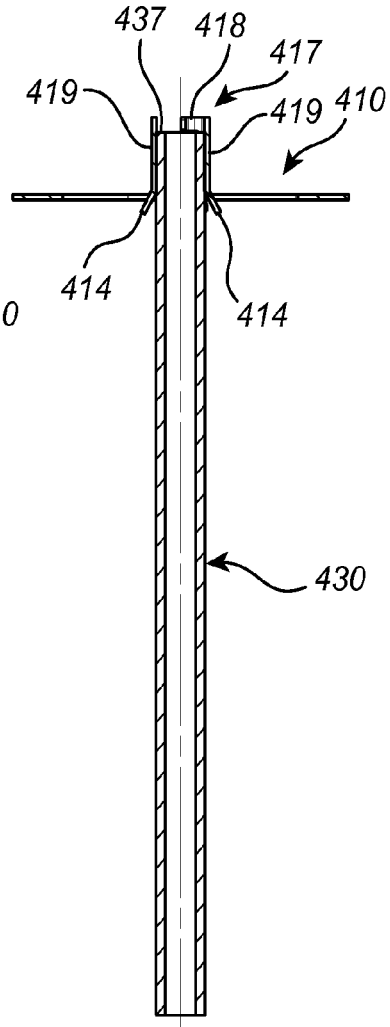
Figure 4C:
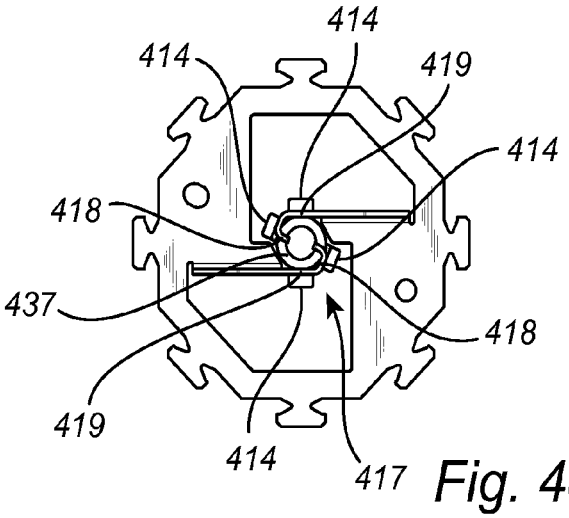

FIGS. 4*a* to 4*c* show a mechanical fastening part 410 connected to a stem 430 according to another embodiment. FIG. 4*a* is a perspective view, FIG. 4*b* is a cross-section taken along line A-A in FIG. 4*a*, and FIG. 4*c* is a top view.

The mechanical fastening part 410 and the stem 430 according to the present embodiment may be similarly configured as the mechanical fastening part and the stem according to the embodiment described with reference to FIGS. 3*a* to 3*c*, except that the geometrical feature 417 of the mechanical fastening part 410 may comprise one or more end stop features 418 arranged to engage with an end portion 437, such as a rim, of the stem 430 so as to limit motion of the mechanical fastening 410 part relative to the stem 430 in a direction along the longitudinal axis of the stem 430 and towards the cap (i.e. downwards in FIGS. 4*a* and 4*b*). For example, the end stop features 418 may be formed by folding or bending a portion of the metal sheet. In the present embodiment, no particular geometrical feature of the stem 430 is necessary and the stem 430 may optionally be free from such geometrical feature, thereby being easier to manufacture. Optionally, the mechanical fastening part 410 may further comprise guiding features 414 for facilitating threading the mechanical fastening part 410 onto the stem 430. The guiding features 418 may e.g. be arranged at the lower end of the flanges 419.

Figure 5A:
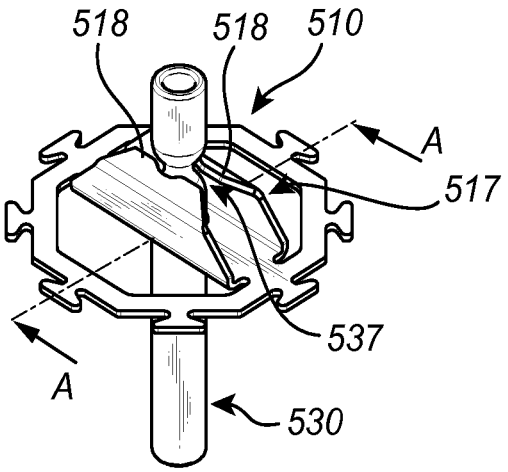
FIGS. 5*a* to 5*c* show a mechanical fastening part connected to a stem according to yet another embodiment.
Figure 5B:
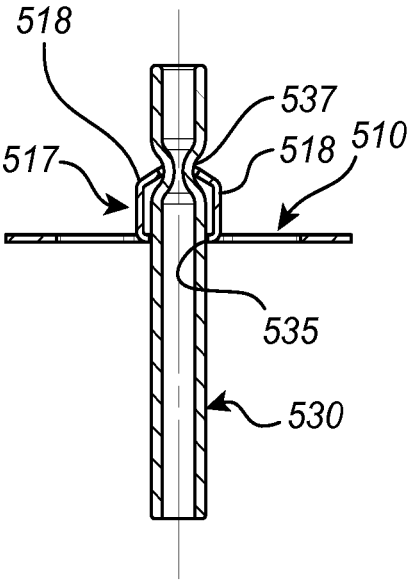
Figure 5C:
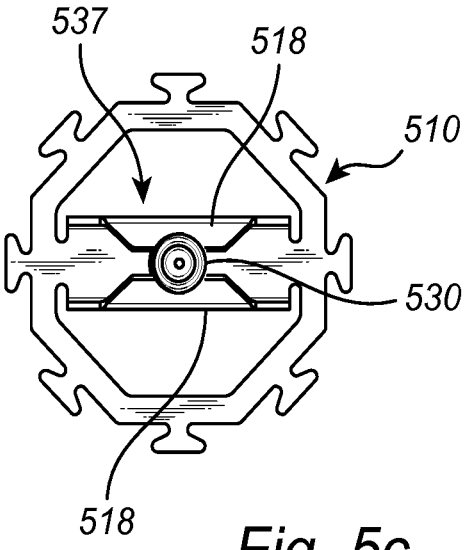

FIGS. 5*a* to 5*c* show a mechanical fastening part 510 connected to a stem 530 according to yet another embodiment. FIG. 5*a* is a perspective view, FIG. 5*b* is a cross-section taken along line A-A in FIG. 5*a*, and FIG. 5*c* is a top view.

The mechanical fastening part 510 and the stem 530 according to the present embodiment may be similarly configured as the mechanical fastening parts and the stems according to any of the previously described embodiments, except that the geometrical feature 517 of the mechanical fastening part 510 may comprise one or more (such as two) flanges 518, which may be referred to as hooks, shaped so as to mate with an indent 537, such as a circumferential indent 537 of the stem 530, thereby limiting motion of the mechanical fastening part 510 relative to the stem 530. The flanges 518 may preferably be arranged on opposite sides of the stem 530 so as to support the stem 530 from opposite sides. For example, the flanges 518 may be formed by cutting and folding the metal sheet. Further, the void in the center portion of the mechanical fastening part 510 may be a hole 535 cut out in the center portion of the metal sheet and may enable threading the mechanical fastening part 510 onto the stem 530. The present embodiment is advantageous in that it is more robust and has less folds and bends, which facilitates manufacturing of the mechanical fastening part 510.

Figure 6A:
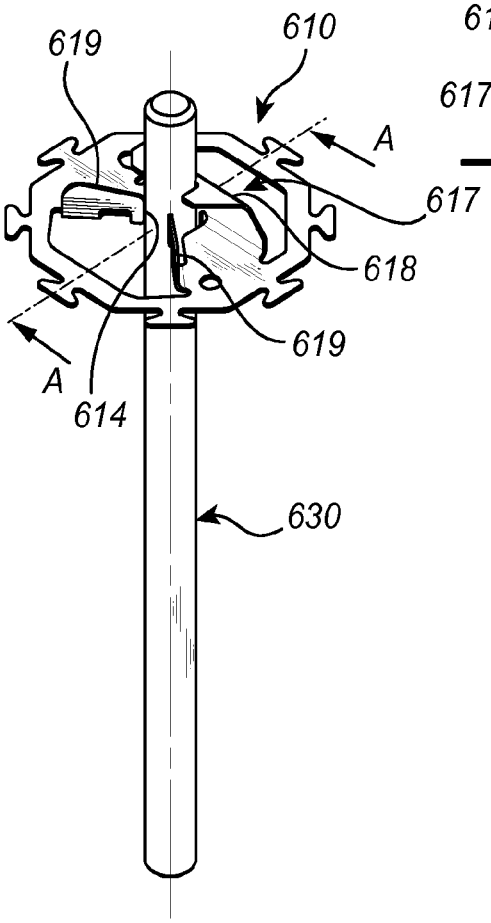
FIGS. 6*a* to 6*d* show a mechanical fastening part connected to a stem according to yet another embodiment.
Figure 6B:
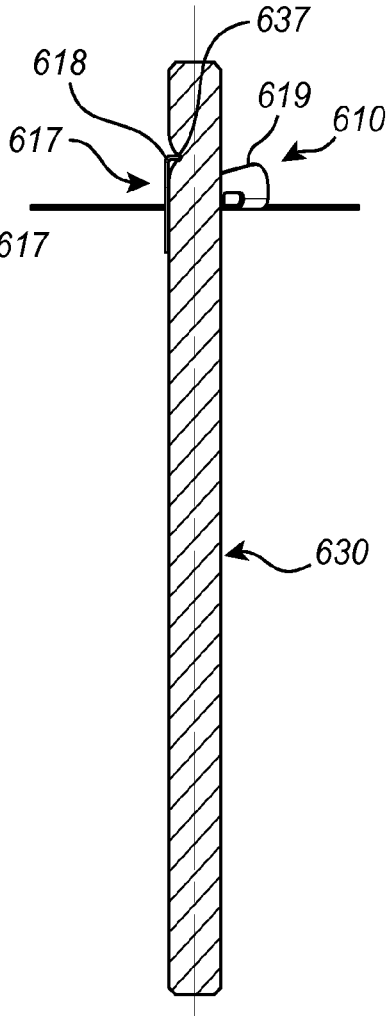
Figure 6C:
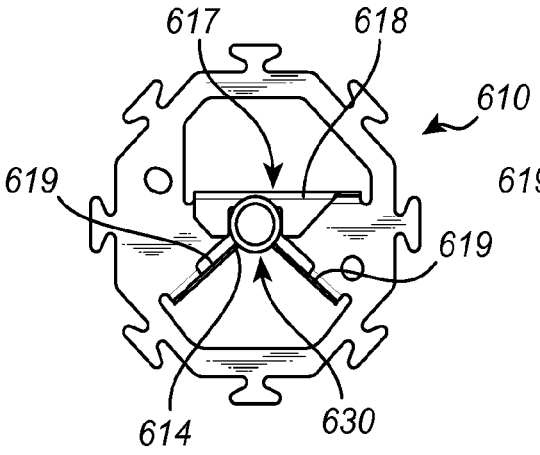
Figure 6D:
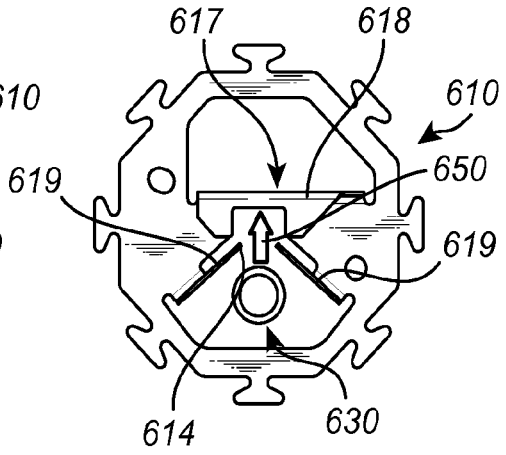

FIGS. 6*a* to 6*d* show a mechanical fastening part 610 connected to a stem 630 according to yet another embodiment. FIG. 6*a* is a perspective view, FIG. 6*b* is a cross-section taken along line A-A in FIG. 6*a*, FIG. 6*c* is a top view illustrating when the stem 630 has been inserted in the void at the center portion of the mechanical fastening part 610, and FIG. 6*d* is a top view illustrating when the stem 630 is being inserted in the void at the center portion of the mechanical fastening part 610.

The mechanical fastening part 610 and the stem 630 according to the present embodiment may be similarly configured as the mechanical fastening part and the stem according to the embodiment described with reference to FIGS. 5*a* to 5*c*, except that the geometrical feature 617 of the mechanical fastening part 610 may comprise a single flange 618, which may be referred to as a hook, shaped so as to mate with an indent 637 of the stem. In the present embodiment, the indent 637 may not necessarily extend circumferentially around the whole stem 630, but merely at one side of the stem 630. The geometrical feature 617 of the mechanical fastening part 610 may further comprise one or more (such as two) locking features 619 (which may be referred to as locking fingers) arranged to hold the stem 630 in the void at the center portion of the mechanical fastening part 610. The locking features 619 may also be arranged to guide the stem 630 into place at the center of the mechanical fastening part 610 upon assembly, as illustrated in FIG. 6*d*. The stem 630 may be placed eccentrically with the stem 630 and then moved in direction towards the center of the mechanical fastening part 610, as illustrated by arrow 650 in FIG. 6*d*, and pressed to pass the locking features 619, thereby being snapped into the right position at the center of the mechanical fastening part 610.

Figure 7A:
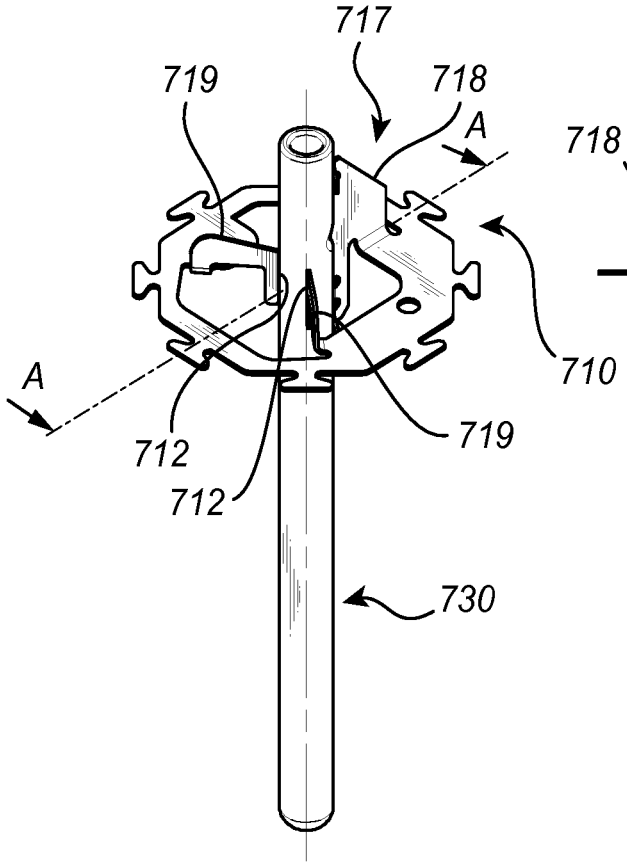
FIGS. 7*a* to 7*c* show a mechanical fastening part connected to a stem according to yet another embodiment.
Figure 7B:
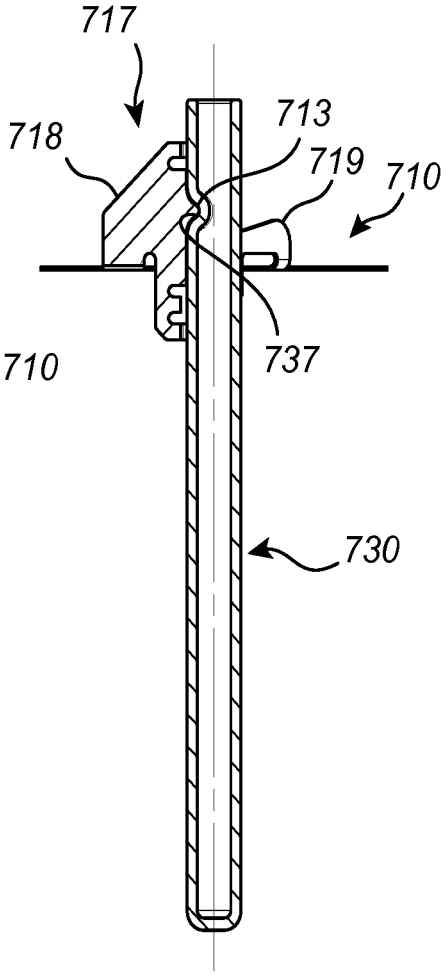
Figure 7C:
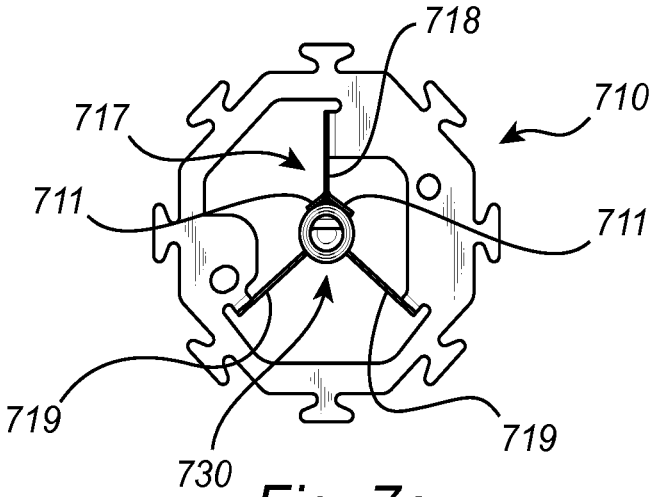

FIGS. 7*a* to 7*c* show a mechanical fastening part 710 connected to a stem 730 according to yet another embodiment. FIG. 7*a* is a perspective view, FIG. 7*b* is a cross-section taken along line A-A in FIG. 7*a*, and FIG. 7*c* is a top view.

The mechanical fastening part 710 and the stem 730 according to the present embodiment may be similarly configured as the mechanical fastening part and the stem according to the embodiment described with reference to FIGS. 6*a* to 6*d*, except that the geometrical feature 717 of the mechanical fastening part 710 may comprise a flange 718 with an edge extending along the longitudinal direction of the stem 730 having a protrusion 719 (or dent) adapted to mate with the indent 737 of the stem 730. The flange 718 may further comprise folded portions 711, which together with the locking features 719 may be adapted to hold the stem 730 in position at the center of the mechanical fastening part 710. Optionally, the edges 712 of the locking features 719 may be long enough (and preferably straight) to act as aligning features for making the light generating unit better aligned with the stem 630.

Figure 8A:
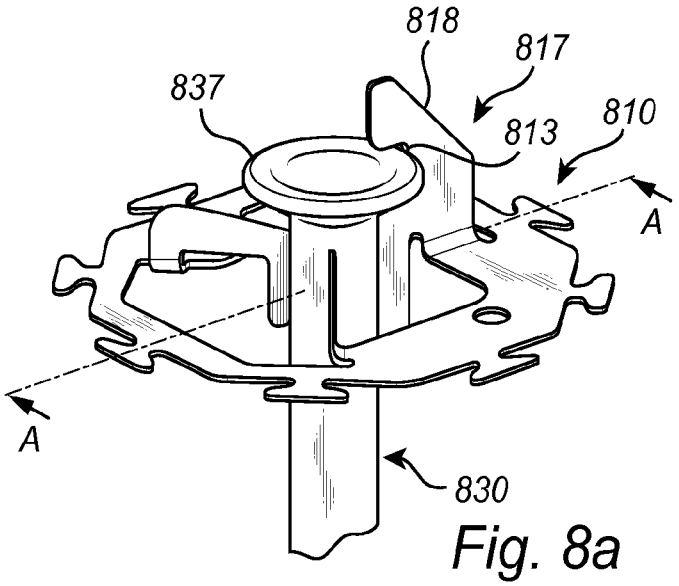
FIGS. 8*a* to 8*c* show a mechanical fastening part connected to a stem according to yet another embodiment.
Figure 8B:
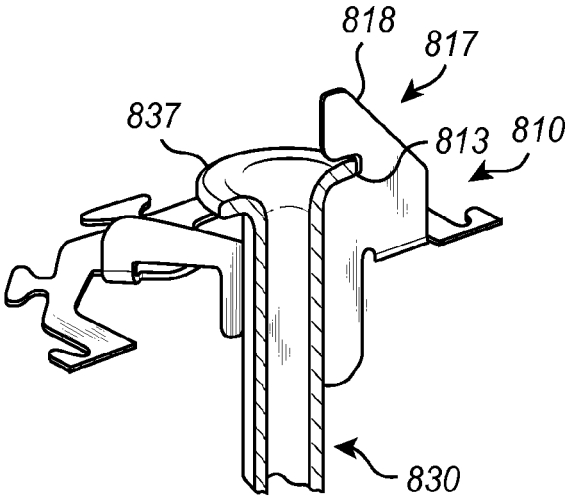
Figure 8C:
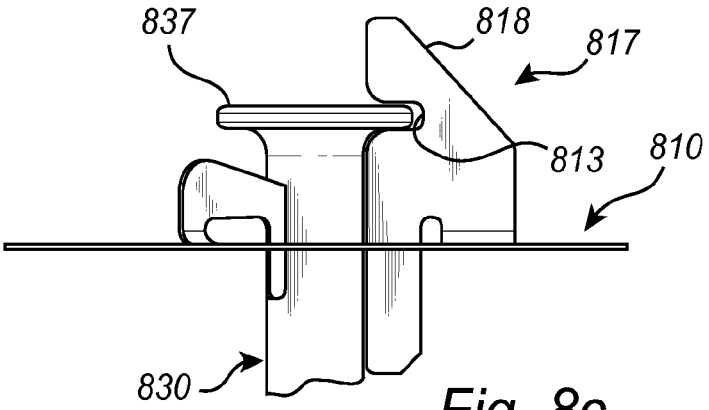

FIGS. 8*a* to 8*c* show a mechanical fastening part 810 connected to a stem 830 according to yet another embodiment. FIG. 8*a* is a perspective view, FIG. 8*b* is a cross-section taken along line A-A in FIG. 8*a*, and FIG. 8*c* is a side view.

The mechanical fastening part 810 and the stem 830 according to the present embodiment may be similarly configured as the mechanical fastening part and the stem according to the embodiment described with reference to FIGS. 7*a* to 7*c*, except that the edge of the flange 818 of the geometrical feature 818 of the mechanical fastening part 810 may comprise an indent 813 adapted to mate with a flare 837 at the end of the stem 830, thereby limiting movement of the mechanical fastening part 810 relative to the stem 830 in the longitudinal direction of the stem 830.

FIGS. 9*a* to 9*e* show a mechanical fastening part 910 connected to a stem 930 according to another embodiment.

Figure 9A:
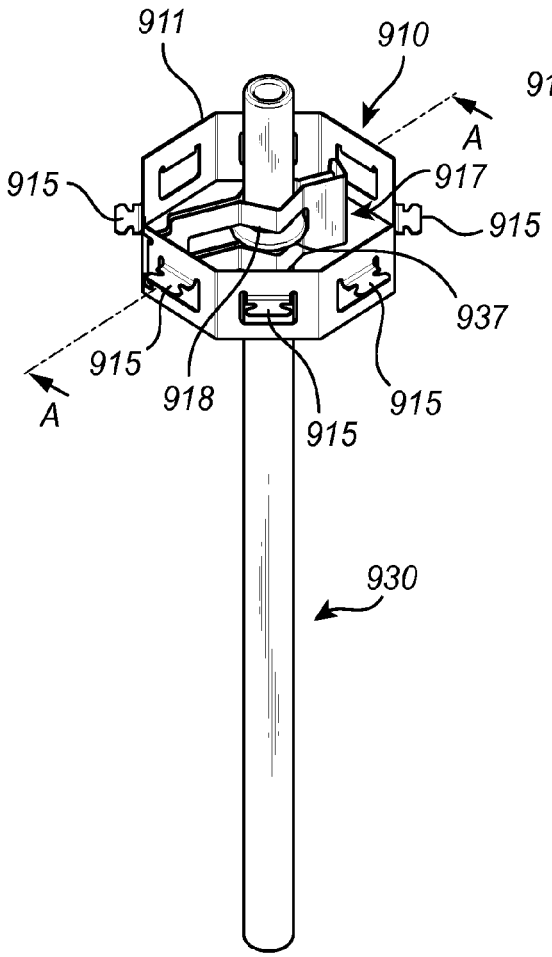
FIGS. 9*a* to 9*e* show a mechanical fastening part connected to a stem according to another embodiment.
Figure 9B:
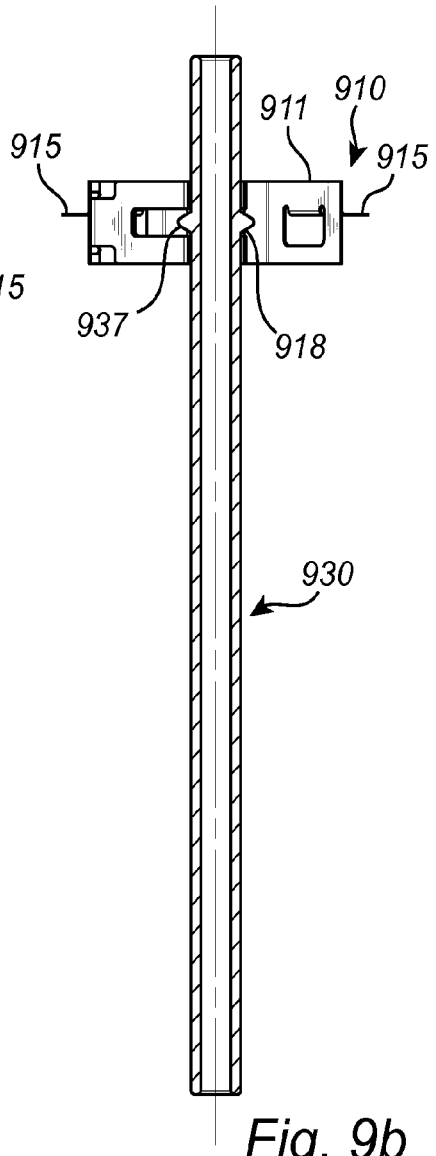
Figure 9C:
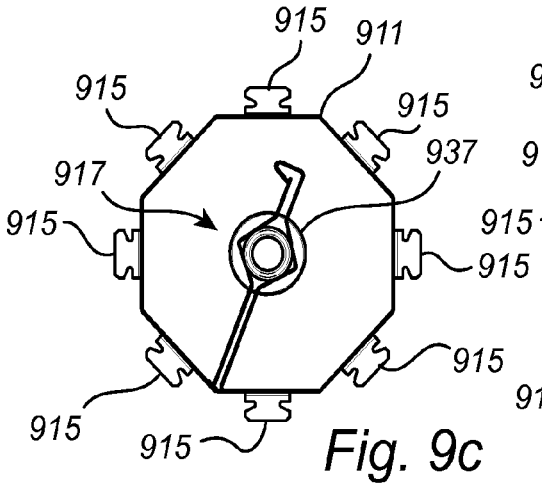
Figure 9D:
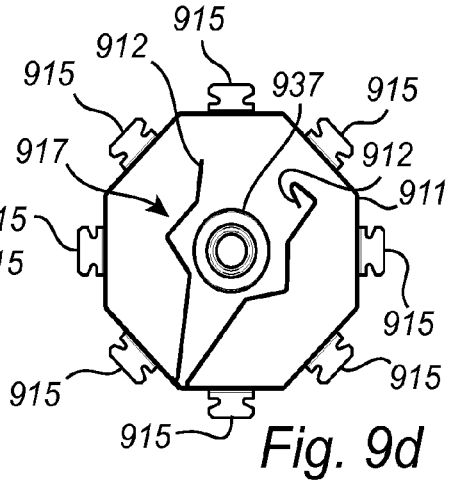
Figure 9E:
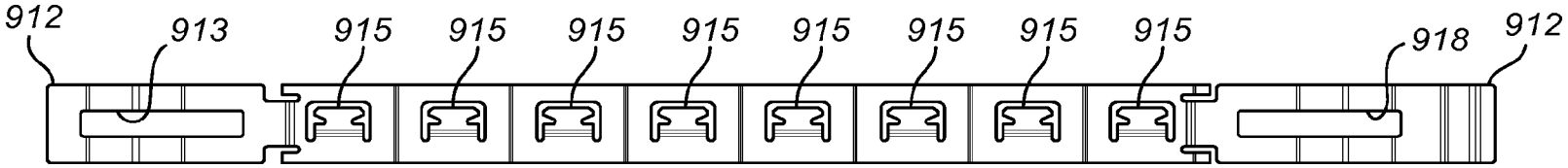

FIG. 9*a* is a perspective view, FIG. 9*b* is a cross-section taken along line A-A in FIG. 9*a*, FIG. 9*c* is a top view illustrating the mechanical fastening part 910 in a closed position, FIG. 9*d* is a top view illustrating the mechanical fastening part 910 in an open position, and FIG. 9*e* shows a metal sheet 911 before it is folded to form the mechanical fastening part 910.

In the present example, the general extension of the metal sheet 911 forming the mechanical fastening part 910 may be directed along (such as substantially parallel with) the longitudinal direction of the stem 930. For example, the metal sheet 911 may be formed as a strip (as illustrated in FIG. 9*e*) folded into a cylinder-like (annular) shape (as illustrated in FIGS. 9*a* to 9*d*), the longitudinal axis of which may be directed along the longitudinal axis of the stem 930. The protrusions 915 may be cut in the metal sheet 911 and folded so as to extend in a radial direction of the mechanical fastening part 910. A portion of the metal sheet strip 911 may be folded so as to form a geometrical feature 917 of the mechanical fastening part 910 and so as to extend inwards in the cylinder-like shape of the mechanical fastening part 910. The geometrical feature 917 may comprise a cut out (or hole) 918 adapted to mate with a geometrical feature 937, such as a rim (or other protrusion), of the stem 930. Further, the end portions 912 of the metal sheet strip 911 may be arranged to engage with each other so as to lock the geometrical feature around the stem 930 such that the cut out 918 of the mechanical fastening part 930 mates with the rim 937 of the stem 930. Hence, the geometrical feature 917 of the mechanical fastening part 910 may be in an open position, as illustrated in FIG. 9*d*, when inserting the stem 930 at the center portion of the mechanical fastening part 910. Then the geometrical feature 917 may be closed such that the end portions 912 of the sheet metal strip 911 engages with each other, thereby fixing the mechanical fastening part 910 to the stem 930. The present embodiment is advantageous in that the connection between the stem 930 and the mechanical fastening part 910 is stiffer.

Figure 10A:
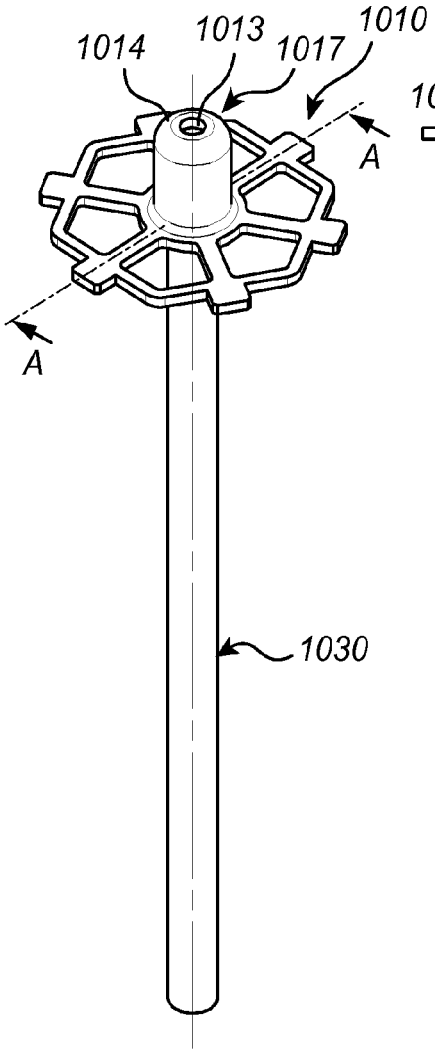
FIGS. 10*a* to 10*c* show a mechanical fastening part connected to a stem according to yet another embodiment.
Figure 10B:
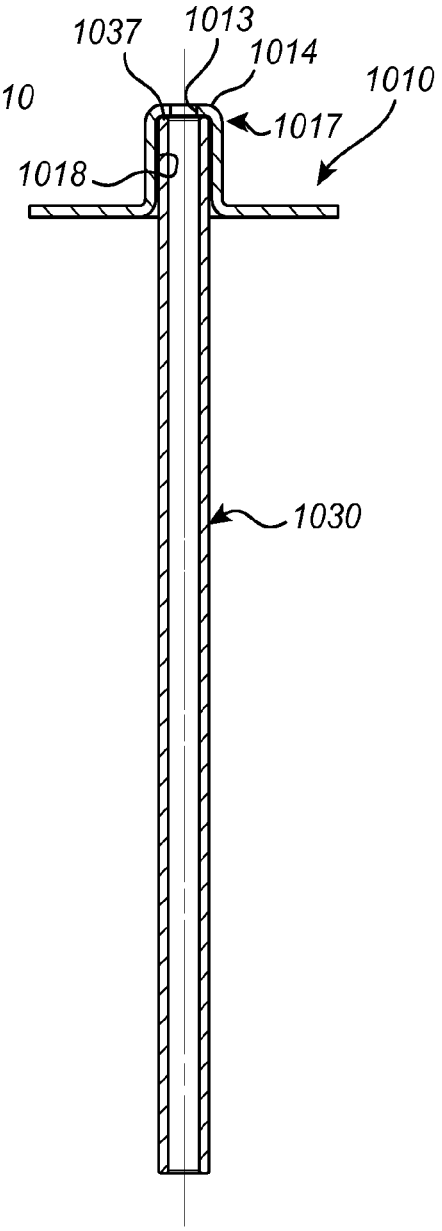
Figure 10C:
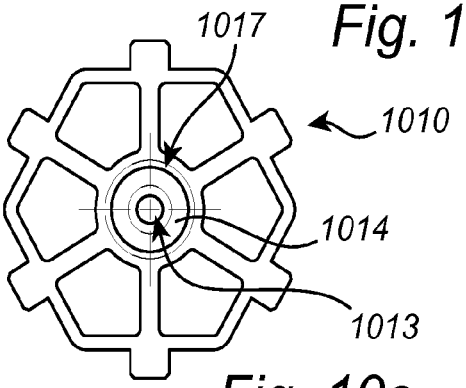

FIGS. 10*a* to 10*c* show a mechanical fastening part 1010 connected to a stem 1030 according to yet another embodiment. FIG. 10*a* is a perspective view, FIG. 10*b* is a cross-section taken along line A-A in FIG. 10*a*, and FIG. 10*c* is a top view.

In the present embodiment, the geometrical feature 1017 of the mechanical fastening part 1010 may comprise a cylindrical feature 1018 adapted to mate with an end portion 1037 of the stem 1030. Preferably, the end portion 1014 of the cylindrical feature 1018 may be at least partially closed, thereby preventing motion of the mechanical fastening part 1010 relative to the stem 1030 along the longitudinal direction of the stem 1030 towards the cap (i.e. downwards in FIGS. 10*a* and 10*b*). Preferably, an opening 1013 may be provided in the cylindrical feature for preventing a gas pocket to form in the stem 1030 during usage of the lighting device. For example, the geometrical feature 1017 of the mechanical fastening part 1010 may be formed by means of deep drawing the metal sheet.

Figure 11:
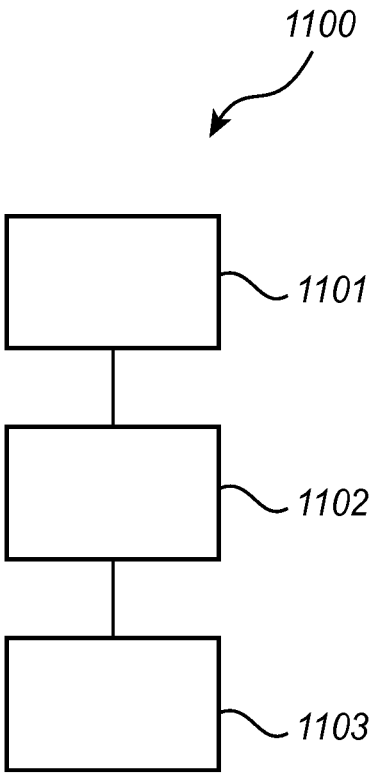
FIG. 11 is a schematic illustration of a method of manufacturing a lighting device according to an embodiment.

A method 1100 of manufacturing a lighting device according to an embodiment will be described with reference to FIG. 11. The method 1100 may comprise arranging 1101 a mechanical fastening part on a stem, the mechanical fastening part comprising at least one protrusion, arranging 1102 a light generating unit comprising at least one hole on the mechanical fastening part such that the at least one hole mates with the at least one protrusion, thereby fastening the light generating unit to the mechanical fastening part, and arranging 1103 the stem at least partially inside an envelope such that the light generating unit is supported by the stem in the envelope. The lighting device may e.g. be a lighting device according to any one of the previously described embodiments.

The step of arranging 1102 the light generating unit on the mechanical fastening part according to an embodiment will be described in more detail with reference to FIGS. 12*a* to 12*e* schematically illustrating the light generating unit being wound (or rolled) onto the mechanical fastening part.

Figure 12A:
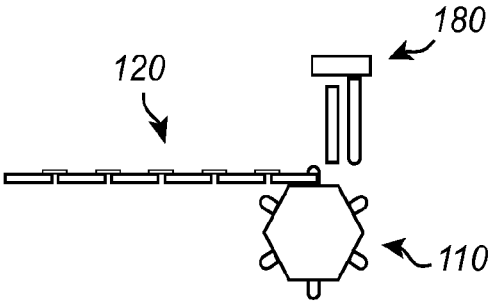
FIGS. 12*a* to 12*e* show a part of a method of manufacturing a lighting device according to an embodiment.
Figure 12D:
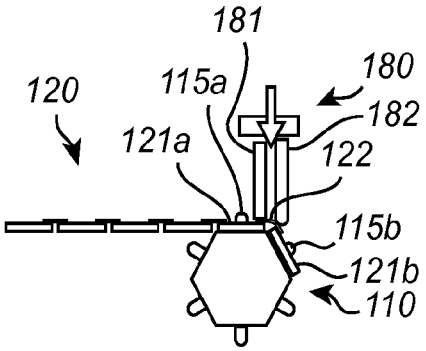
Figure 12B:
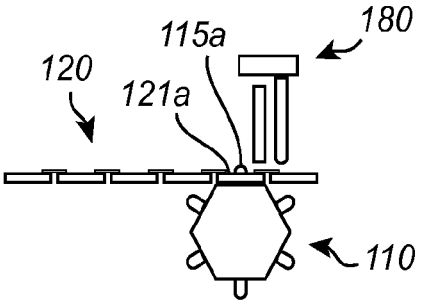
Figure 12E:
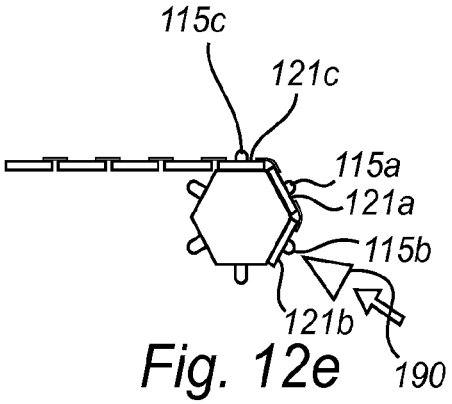
Figure 12C:
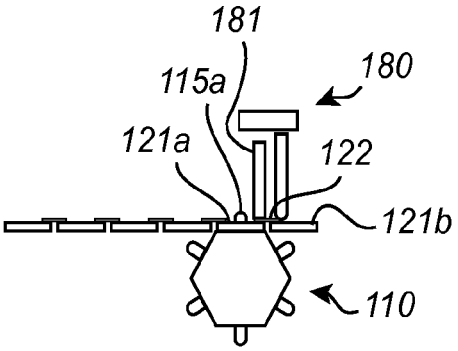

Firstly, a manufacturing tool 180 may be open, the light generating unit 120 may be inserted in the tool 180 and the mechanical fastening part 110 may be put in position at the manufacturing tool 180, as illustrated in FIG. 12*a*. Then, a first one of the carriers 121*a* (such as the second carrier seen from one of the ends of the light generating unit) is positioned such that the hole of the carrier 121*a* mates with a first one of the protrusions 115*a* of the mechanical fastening part 110, as illustrated in FIG. 12*b*. A clamping tool 181 of the manufacturing tool 180 may then hold (or clamp) the connecting element 122 connecting the first carrier 121*a* to the neighboring carrier 121*b*, as illustrated in FIG. 12*c*. Further, a bending tool 182 of the manufacturing tool 180 may press down the neighboring carrier 121*b* such that the hole of the neighboring carrier 121*b* mates with the neighboring protrusion 115*b*. Preferably, the bending tool may press the neighboring carrier 121*b* at the position of the connecting element 122. Similarly, another neighboring carrier 121*c* may be pressed such that the hole of that carrier 121*c* mates with another neighboring protrusion 115*c* of the mechanical fastening part 110, as illustrated in FIG. 12*e*. This process may continue until the complete light generating unit 120 has been wound onto the mechanical fastening part 110. Further, a crimping tool 190 may deform, such as twist or fold, some or all of the protrusions 115*a*, 115*b*, 115*c* of the mechanical fastening part 110 so as to further secure the light generating unit 120 onto the mechanical fastening part 110.

In the following, further non-limiting examples of embodiments of the invention will be described.

To be able for LED lamps to leverage on the high volume production capabilities of cheap GLS lines, new assembly and fixations means for LED substrates may be needed to replace those used for filament placement and halogen burner placement. To reduce cost and to increase the production speed, only small modifications can be made to both glass lamp parts and production lines. In the following, it is described how a 3D structure of multiple L2 boards can be mounted to a standard stem of a glass (incandescent) bulb with small changes to said stem and consequently the production line. This allows the GLS productions lines to be used for the production of LED lamps.

Incandescent lamps incorporate supporting structures for their filaments. With advent of halogen lamps based on GLS designs, new fixation means were introduced that did not require the basic design of the stem to be changed. Halogen lamp production was thus able to leverage on the incandescent production. For LED lamps to be able to leverage on the GLS production, a similar solution is needed.

Over the past decades, GLS production lines have been improved for speed and efficiency. With the accelerating transition from conventional light bulb to LED bulbs, the demand for LED bulbs is putting a lot of pressure on the slow (1000 pcs/hr) production lines. LED bulb production lines are slowly moving towards (semi)automation, but it would be advantageous to utilize the existing high speed (4000 pcs/hr) lines for GLS. As the GLS lines are so well optimized, they have limited flexibility wrt design of the bulbs. Therefore, to reduce cost and keep the production speed high, only small modifications can be made to both glass lamp parts and production lines. Below, it is described an example of how a 3D structure of L2 boards (forming a thermal chimney) can be mounted to a standard stem with only small changes to said stem and consequently the production line.

Generally, an LED bulb may comprise an optical part and a thermal part that each roughly takes up 50% of the outer surface. Usually, the thermal part may comprise mostly metal for high thermal conductivity, thus lowering the internal thermal resistance of the lamp.

The LED lamp described in the following example may rely on an outer surface that is similar to a GLS lamp, thus fully made of glass. To cope with the intrinsically high internal thermal resistance of a gas filled glass bulb, a smart design is desired to effectively spread the heat inside the lamp. In order to do so, a LED structure was conceived that functions as a thermal chimney. Such a 3D structure of multiple L2s, may pose a problem for assembly.

A solution to this problem may be a simple (sheet metal) part that may have several functions: it may function as a ratchet/guide for ease of assembly of a flat L2 shape to a 3D L2 shape; it may support and position the 3D L2 assembly inside the lamp to the stem; it may orientate the L2 assembly to the stem to assist welding of L2 wires to stem wires; it may have an open structure to allow gas to flow through, for thermal dissipation and heat spreading; it may allow the L2 assembly to stay fixed to the stem at high g-forces (typically 850 g) that can occur during handling both in the factory as by end users.

The sheet metal supporting structure may preferably: fixate some or all six degrees of freedom of the L2 assembly; not degas (preventing lumen decay); imply reduced material use; have a reduced number of bends and be easy to cut (to save cost).

The (extended) pump tube of the stem may have a flare, bump, rim or indentation for mechanical fixation.

According to an example, a lighting device may be provided, which can be manufactured on the traditional lines for GLS lamps, that is the well-known incandescent lamp. The lamp may comprise a glass bulb, a glass stem and a lamp cap which may be similar to the GLS lamp. In the lamp, the light generating part may comprise a plurality of carriers each provided with one or more solid state light sources, like for instance LEDs. These carriers may be arranged around the glass stem and may be connected to the mechanical fixation part. The mechanical fixation part may be connected with the glass stem.

Further, the bulb may be filled with a He—O2 gas mixture for improving the thermal performance of the lamp. A LED driver may be mounted in the cap of the lighting device, said driver being electrically connected to the outside power supply via the cap, and further electrically connected to the light generation part via the wires that are positioned along the stem.

Itemized List of Embodiments

1. A lighting device comprising an envelope, a stem positioned inside the envelope and a cap arranged at the lower side of the stem and connected to said envelope, characterized in that the lighting device further comprises a light generating unit connected to the stem via mechanical fixation means.

2. The lighting device according to item 1, characterized in that the light generation means comprises at least one carrier with at least one solid state light source.

3. The lighting device according to item 1, characterized in that the light generation means comprises a plurality of carriers with at least one solid state light source.

4. The lighting device according to item 1, characterized in that the mechanical fixation means are mechanically coupled to the stem.

5. The lighting device according to item 4, characterized in that the mechanical fixation means are a deep drawn part or a folded metal sheet.

6. The lighting device according to item 1, characterized in that the stem is made from glass.

7. The lighting device according to item 1, characterized in that the stem is further provided with an indent, a rim, a bump or a flare for the fixation of the mechanical fixation means.

8. The lighting device according to item 1, characterized in that the envelope is made from glass.

9. The lighting device according to item 1, characterized in that the envelope is at least partly transparent or translucent.

10. The lighting device according to item 1, characterized in that the lighting device further comprises a driver unit.

11. The lighting device according to item 10, characterized in that said driver unit is electrically connected to the cap for connecting it to an outside power source.

12. The lighting device according to item 1, characterized in that the envelope is filled with a Helium-Oxygen mixture.

13. A method for manufacturing a lighting device, comprising the following steps;

mounting the LEDs on a carrier arranging the one or more carriers on mechanical fixation means connecting the mechanical fixation means to the stem inserting the sub-assembly of carriers with LEDs, mechanical fixation means and stem in the envelope connecting the stem to the envelope creating the helium-oxygen mixture in the envelope closing the envelope mounting the cap The person skilled in the art realizes that the present invention by no means is limited to the preferred embodiments described above. On the contrary, many modifications and variations are possible within the scope of the appended claims. For example, the mechanical fastening part may be made of another material than sheet metal, such as cast metal, plastic or ceramic.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting device comprising:

an envelope, a light generating unit, a stem arranged to support the light generating unit inside the envelope, and a mechanical fastening part arranged to fasten the light generating unit at the stem, wherein said light generating unit being arranged to at least partially surround the stem, thereby forming a chimney-like structure, wherein the mechanical fastening part comprises at least one protrusion and the light generating unit comprises at least one hole adapted to mate with the at least one protrusion so as to fasten the light generating unit to the mechanical fastening part, and wherein the stem is light transmissive.

2. The lighting device as defined in claim 1, wherein the at least one hole comprises a through hole.

3. The lighting device as defined in claim 1, wherein the mechanical fastening part comprises a plurality of protrusions arranged around a longitudinal axis of the stem.

4. The lighting device as defined in claim 1, wherein the light generating unit is arranged to at least partially surround the mechanical fastening part.

5. The lighting device as defined in claim 1, wherein the light generating unit comprises one or more carriers and one or more solid state light sources arranged at the one or more carriers.

6. The lighting device as defined in claim 5, wherein the at least one hole is arranged in the carrier.

7. The lighting device as defined in claim 1, wherein the mechanical fastening part comprises a metal sheet.

8. The lighting device as defined in claim 7, wherein the metal sheet is folded or deep drawn so as to define at least one geometrical feature adapted to fasten the mechanical fastening part to the stem.

9. The lighting device as defined in claim 7, wherein an edge of the metal sheet is shaped so as to define the at least one protrusion.

10. The lighting device as defined in claim 1, wherein the stem comprises a geometrical feature arranged to mate with a geometrical feature of the mechanical fastening part so as to fasten the mechanical fastening part to the stem.

11. The lighting device as defined in claim 1, wherein the stem comprises glass.

12. The lighting device as defined in claim 1, further comprising a cap connected to the envelope and supporting the stem in the envelope.

13. The lighting device as defined in claim 1, wherein the at least one protrusion is shaped so as to lock the light generating unit to the mechanical fastening part.

14. A method of manufacturing a lighting device, the method comprising:

arranging a mechanical fastening part on a stem, the mechanical fastening part comprising at least one protrusion, wherein the stem is light transmissive, arranging said light generating unit to at least partially surround the stem, thereby forming a chimney-like structure, arranging said light generating unit comprising at least one hole on the mechanical fastening part such that the at least one hole mates with the at least one protrusion, thereby fastening the light generating unit to the mechanical fastening part, and arranging the stem at least partially inside an envelope such that the light generating unit is supported by the stem in the envelope.

* * * * *